US006334584B1

(12) United States Patent
Bauer, Jr. et al.

(10) Patent No.: US 6,334,584 B1
(45) Date of Patent: Jan. 1, 2002

(54) CENTRIFUGAL FINE GRINDING APPARATUS

(75) Inventors: Russell Bauer, Jr., Cincinnati, OH (US); Sean Kelly, Hebron, KY (US)

(73) Assignee: Gabriel International Group, Lawrenceburg, IN (US)

( * ) Notice: Subject to any disclaimer, the term of this patent is extended or adjusted under 35 U.S.C. 154(b) by 28 days.

(21) Appl. No.: 09/591,582

(22) Filed: Jun. 9, 2000

(51) Int. Cl.[7] ..... B02C 18/16
(52) U.S. Cl. ..... 241/259.1; 241/261; 241/DIG. 31
(58) Field of Search ..... 241/261, 259.1, 241/DIG. 31

(56) References Cited

U.S. PATENT DOCUMENTS

| | | | |
|---|---|---|---|
| 3,229,923 A | | 1/1966 | Conley et al. |
| 3,260,469 A | | 7/1966 | Perdreau |
| 3,523,649 A | | 8/1970 | Laakso |
| 4,081,147 A | | 3/1978 | Siefert et al. |
| 4,131,061 A | * | 12/1978 | Skeen |
| 4,164,329 A | | 8/1979 | Higby |
| 4,669,516 A | | 6/1987 | Carpenter et al. |
| 4,681,146 A | | 7/1987 | Liska et al. |
| 4,767,065 A | | 8/1988 | Wray |
| 5,509,610 A | | 4/1996 | Gibbons et al. |
| 5,730,376 A | | 3/1998 | Schneid et al. |

OTHER PUBLICATIONS

Gabriel International Group, G6000, G2400, Brouchure, undated.

Gabriel International Group, G2400—The Finest Scrap Tire Crump rubber Equipment Made, Brochure, undated.

* cited by examiner

*Primary Examiner*—Mark Rosenbaum
(74) *Attorney, Agent, or Firm*—Wood, Herron & Evans, L.L.P.

(57) ABSTRACT

An apparatus for fine grinding material, such as waste automotive tires. The apparatus includes first and second plates mounted within a housing. The first and second plates include respective, opposed inclined surfaces and respective pluralities of generally radially extending cutting elements. Each of the generally radially extending cutting elements define a serrated edge extending above the corresponding inclined surface. The serrated edges on the first and second plates intermesh with one another while the opposed inclined surfaces define a grinding space therebetween that gradually becomes more narrow in a radially outward direction. One of the plates is mounted for rotation and a drive is operatively coupled with the one plate for rotating that plate during a grinding operation.

10 Claims, 9 Drawing Sheets

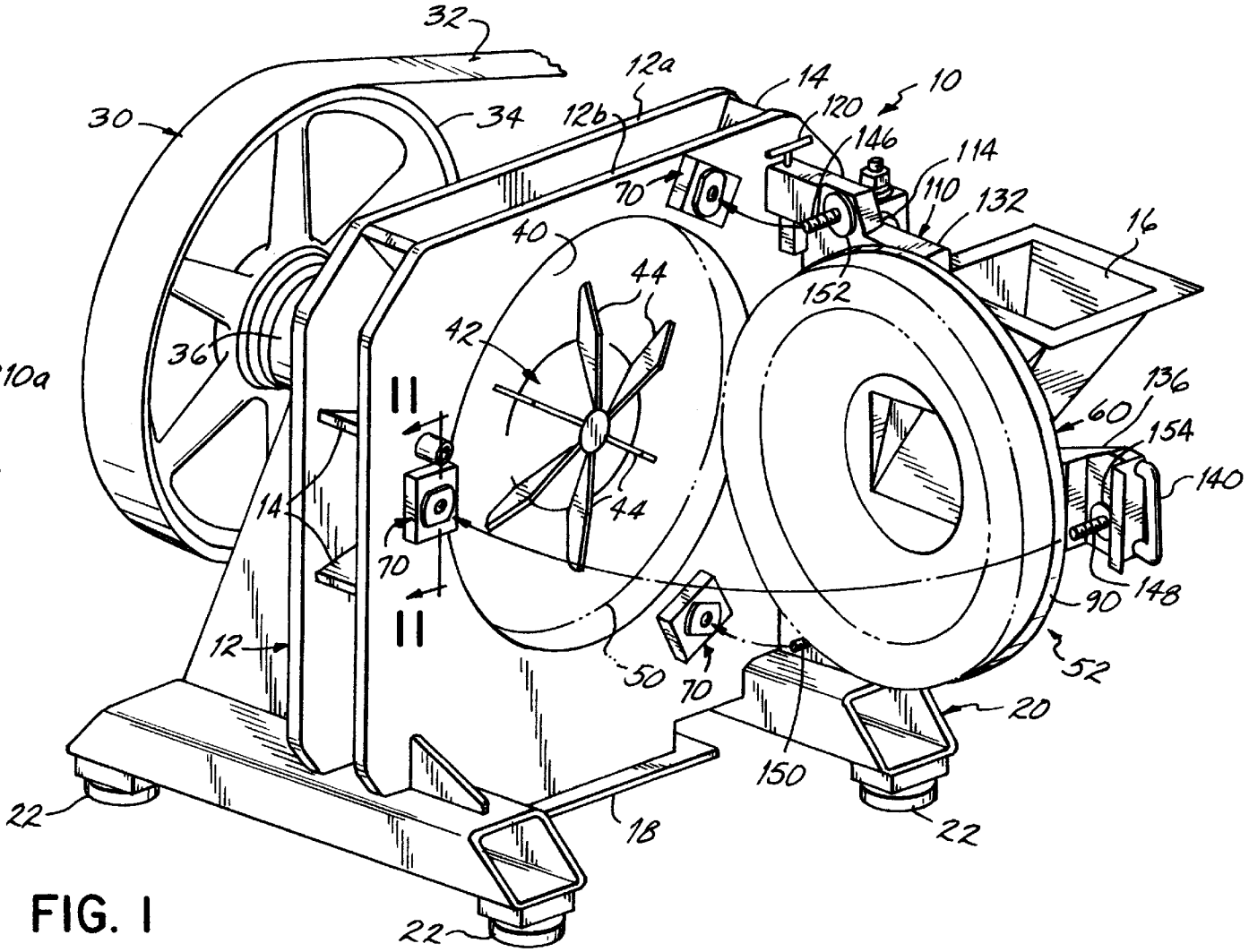
FIG. I
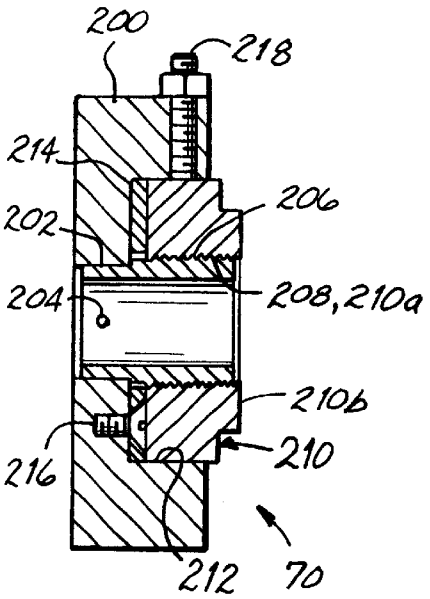
FIG. II

CENTRIFUGAL FINE GRINDING APPARATUS

FIELD OF THE INVENTION

The present invention generally relates to apparatus for size reduction of material pieces and, more specifically, to an apparatus for fine grinding operations used to reduce material, such as rubber, wood, plastic or other materials, into a fine powdered form.

BACKGROUND OF THE INVENTION

The present invention generally relates to improvements on the apparatus disclosed and claimed in U.S. Pat. No. 5,509,610 (the '610 patent), the disclosure of which is hereby fully incorporated by reference herein. The apparatus disclosed in the '610 patent may be converted from a centrifugal chopping apparatus to a centrifugal grinding apparatus to reduce particulate material in stages to smaller and smaller particulates. Often, different machines and operations are necessary in order to reduce large objects, such as waste automotive tires, into useful recyclable powered form. Two other examples of apparatus for shredding waste automotive tires are disclosed in U.S. Pat. Nos. 4,684,071 and 4,927,088.

Such apparatus as disclosed in U.S. Pat. Nos. 4,684,071 and 4,927,088, and other similar devices, are incapable or at least very inefficient at reducing tires into the fine, powered form necessary for recycling or other constructive uses of the rubber material. For example, finely powered rubber may be added to asphalt for paving roads and highways or may be recycled and formed into various rubber containing products. Therefore, it is very important from an environmental standpoint to further increase the efficiency of reducing waste automotive tires to the most useful form, i.e., a powered form, in order to take these waste tires completely out of landfills and recommit their materials of construction to many useful purposes.

Reducing waste automotive tires, and other materials, down to a size of about ¼ inch to ⅜ inch pieces has not been a significant problem in the past. However, the costs associated with the manufacture, operation and maintenance of past grinding machines or size reduction machines capable of grinding or milling these pieces down to, for example, −40 mesh to about 100 mesh is quite high. For example, the costs associated with manufacturing minute openings in the screens used in typical hammer mills and granulators are especially high when considering that the screens must be constantly replaced. The present invention provides even further improvements to the fine grinding abilities of the apparatus disclosed in the '610 patent.

It would also be desirable to address other problems with past methods and apparatus for producing minute particle sizes, including improvements related to more efficient and inexpensive manners of setting up and maintaining the apparatus in an optimum grinding configuration.

SUMMARY OF THE INVENTION

The present invention generally provides a centrifugal grinding apparatus especially useful for fine grinding or milling operations. The apparatus generally includes a housing having an inlet and an outlet. A first disc or plate is secured within the housing and includes a first inclined surface and a plurality of generally radially extending cutting elements. Each of the first plurality of generally radially extending cutting elements define a first serrated edge extending above the first inclined surface. A second disc or plate is mounted within the housing and includes a second inclined surface and a second plurality of generally radially extending cutting elements. Each of the second plurality of generally radially extending cutting elements defines a second serrated edge extending above the second inclined surface and intermeshing with the first serrated edge. The first and second inclined surfaces oppose one another and define a grinding space therebetween that gradually becomes more narrow in a radially outward direction relative to the centers of each plate. At least one of the first and second plates is mounted for rotation within the housing and a drive is operatively coupled to the one plate for rotating same during a grinding operation.

Each of the radially extending cutting elements of the first and second pluralities of generally radially extending cutting elements further includes a plurality of multi-sided blade elements retained on an elongate support member. The multi-sided blade elements each have at least three sides with each side defining a cutting edge and each blade element is retained on the elongate support member in a manner allowing rotation thereof to select different cutting edges thereon to define a corresponding one of the serrated edges. At least some of the multi-sided blade elements have four sides with each side defining one of the cutting edges. A shearing space is defined between the first and second serrated edges and the shearing space also becomes gradually more narrow in a radially outward direction. The inlet is defined at a radially inward location, and preferably a central location of a stationary one of the plates and the outlet is disposed at a radially outward position, preferably at the periphery of the plates such that grinding takes place as the particulate material moves from the radially inward inlet toward the radially outward outlet through the gradually narrowing spaces between the two plates and serrated edges of the cutting elements.

As another feature, at least three adjustment pads are positioned adjacent one of the first and second plates and engage another set of pads adjacent the other plate during the grinding operation. The engagement of these two sets of pads defines the size of the shearing space between the first and second serrated edges. The three adjustment pads are movable, such as through a threaded rotating action, toward and away from the three pads adjacent the other one of the first and second plates. Once the three movable adjustment pads are moved to the desired position they may be locked in place relative to the other three pads to define the size of the shearing space.

Various additional features, objectives and advantages of the invention will become more readily apparent to those of ordinary skill in the art upon review of the following detailed description of the preferred embodiment, taken in conjunction with the the accompanying drawings.

BRIEF DESCRIPTION OF THE DRAWINGS

FIG. 1 is a diagrammatic perspective view of a fine grinding apparatus constructed according to the present invention.

FIG. 11 is a cross sectional view of one adjustment mechanism of the apparatus taken along line 11—11 of FIG. 1.

DETAILED DESCRIPTION OF THE PREFERRED EMBODIMENT

Figure 2:
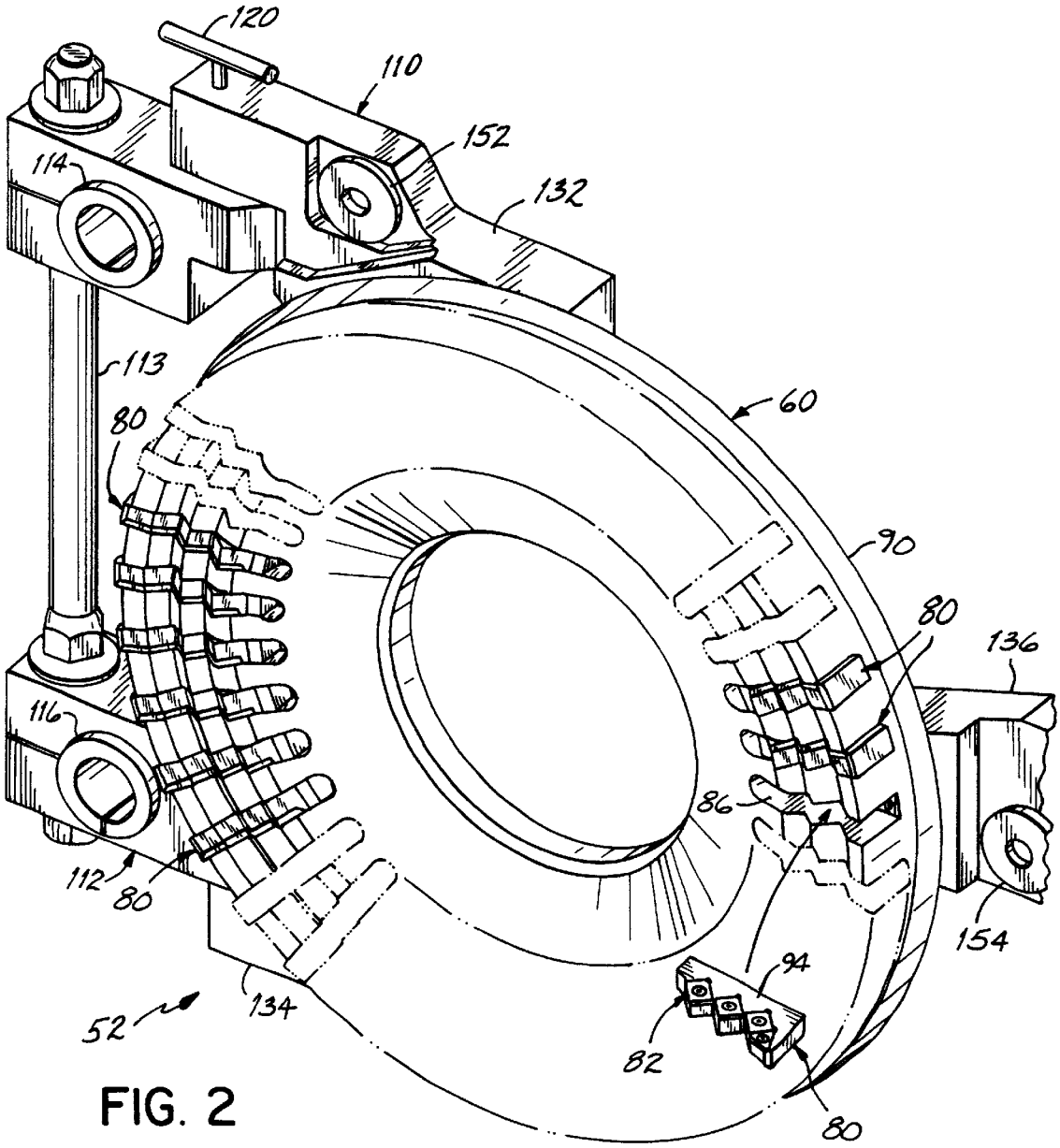
FIG. 2 is a perspective view of the stationary disc or plate of the apparatus showing one of the generally radially extending cutting elements being inserted into a recess thereof.

Referring generally to FIG. 1, the preferred apparatus 10 of the invention comprises a housing 12 including first and second spaced apart plates 12*a,* 12*b* affixed to one another in spaced relation by a plurality of generally radially extending ribs 14. In addition, plates 12*c* (FIG. 7) are welded between plates 12*a* and 12*b* to form a grinding chamber within housing 12 as will be understood from the description below. Housing 12 generally includes a material inlet 16 and a ground material outlet 18. A base 20 having a plurality of feet 22 supports apparatus 10. Feet 22 preferably have a leveling capability. A drive 30 generally comprising a belt 32 and a wheel 34 which may be driven by a suitable electric motor (not shown), such as discussed in the '610 patent, having sufficient power for the particular application. Drive 30 couples to a rotatable shaft 36 extending into a grinding chamber 40. A material distribution wheel 42 is coupled with rotatable shaft 36 and includes a plurality of generally radially extending blades 44 adapted to distribute material falling into grinding chamber 40 through inlet 16 in a radially outward direction upon rotation by drive 30. A rotating grinding plate 50, shown for clarity as a dash-dot line in FIG. 1, is also coupled with rotatable shaft 36. A pivoting and linearly movable door 52 carries a stationary grinding disc or plate 60 also shown for clarity as a dash-dot line in FIG. 1. Door 52 is closed as discussed in more detail below against a plurality of size adjustment mechanisms 70 mounted on plate 12*b.* Mechanisms 70 set the distance between the respective rotating and stationary grinding plates 50, 60 and thereby set the size reduction capability of apparatus 10.

Figure 3:
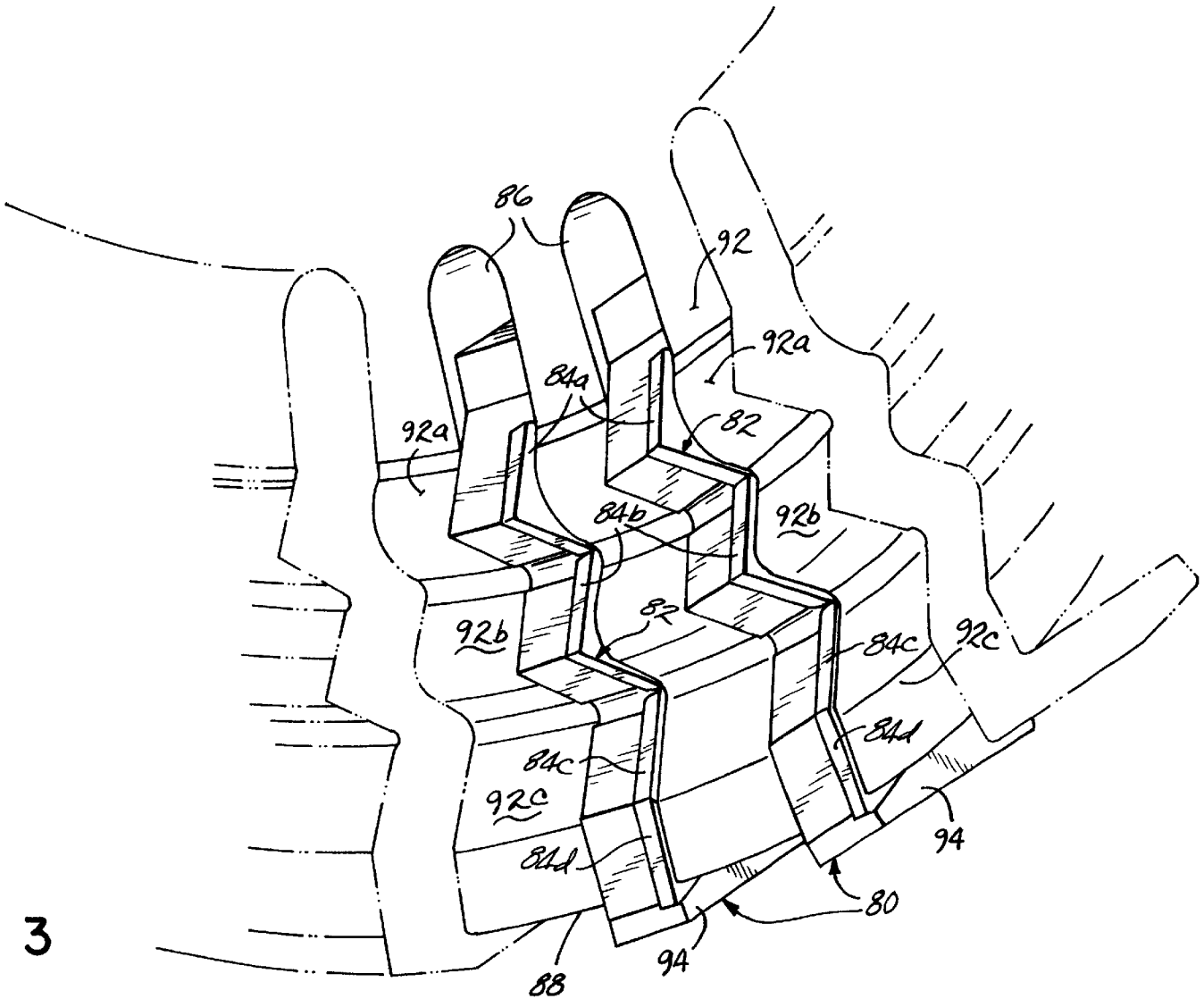
FIG. 3 is an enlarged perspective view of the stationary disc and cutting elements shown in FIG. 2.
Figure 4:
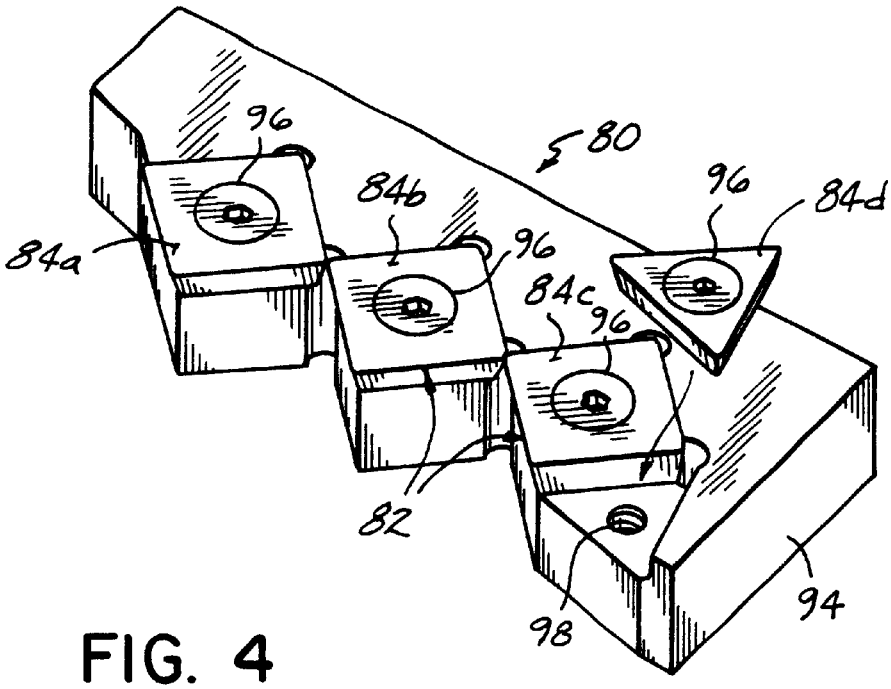
FIG. 4 is a perspective view of a cutting element associated with the stationary disc and showing one of the multi-sided blade elements removed.

FIGS. 2–4 better illustrate the construction of each generally radially extending cutting element 80 and generally of stationary disc or plate 60. Each cutting element 80 generally defines a serrated cutting edge 82 formed along the length of a plurality of multi-sided blade elements 84*a,* 84*b,* 84*c,* 84*d.* As shown in FIG. 2, each cutting element 80 is retained with a corresponding generally radially extending recess 86 within an annular support ring 88 rigidly affixed to an outer mounting plate 90. The inner surface 92 of the annular support ring 88 comprises a ramped or inclined surface, the purpose of which will be described in greater detail below. The serrated edge 82 of each cutting elements 80, as best shown in FIG. 3, extend above the inclined surface 92 of the annular support ring 88. It will be further appreciated that the inclined surface 92 is an undulating surface in which the undulations 92*a,* 92*b,* 92*c* generally correspond to the serrated edge 82 and gradually get closer to the serrated edge 82 in a radially outward direction as also indicated by FIG. 3. Blade elements 84*a–d* are secured to an elongate support member 94 using threaded fasteners 96 retained in threaded holes 98.

Figure 5:
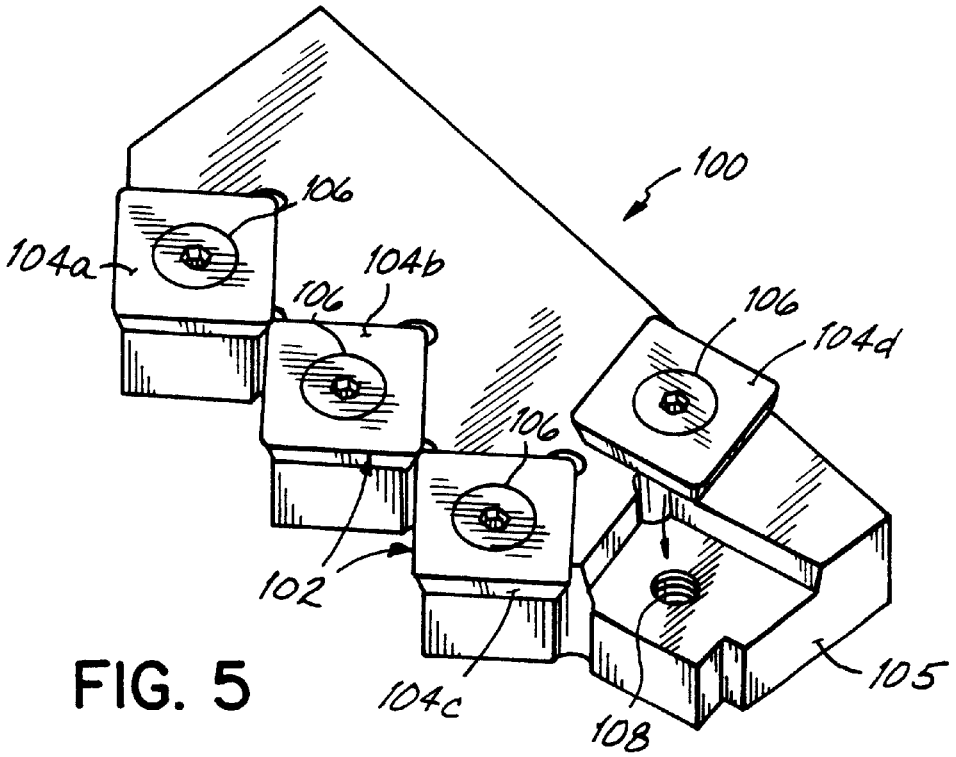
FIG. 5 is a perspective view, partially exploded, showing one of the elongate cutting elements of the rotating disc or plate with one of the multi-sided blade elements removed.

FIG. 5 illustrates a cutting element 100 associated with the rotatable disc or plate 50 also forming a serrated edge 102 with a plurality of multi-sided blade elements 104*a,* 104*b,* 104*c,* 104*d* affixed to an elongate support member. Blade elements 104*a–d* are secured to an elongate support member 105 using threaded fasteners 1–6 retained in threaded holes 108. It will therefore be appreciated that each of the multi-sided blade elements 84*a,* 84*b,* 84*c,* 84*d* and 104*a,* 104*b,* 104*c,* 104*d* shown in FIGS. 4 and 5 may be removed and replaced with new sharpened blade elements or may be removed and rotated such that dull edges of the multi-sided blade elements 84*a–d,* 104*a–d* are replaced by sharp edges of the same element to form the corresponding serrated edge 82, 102.

Figure 6:
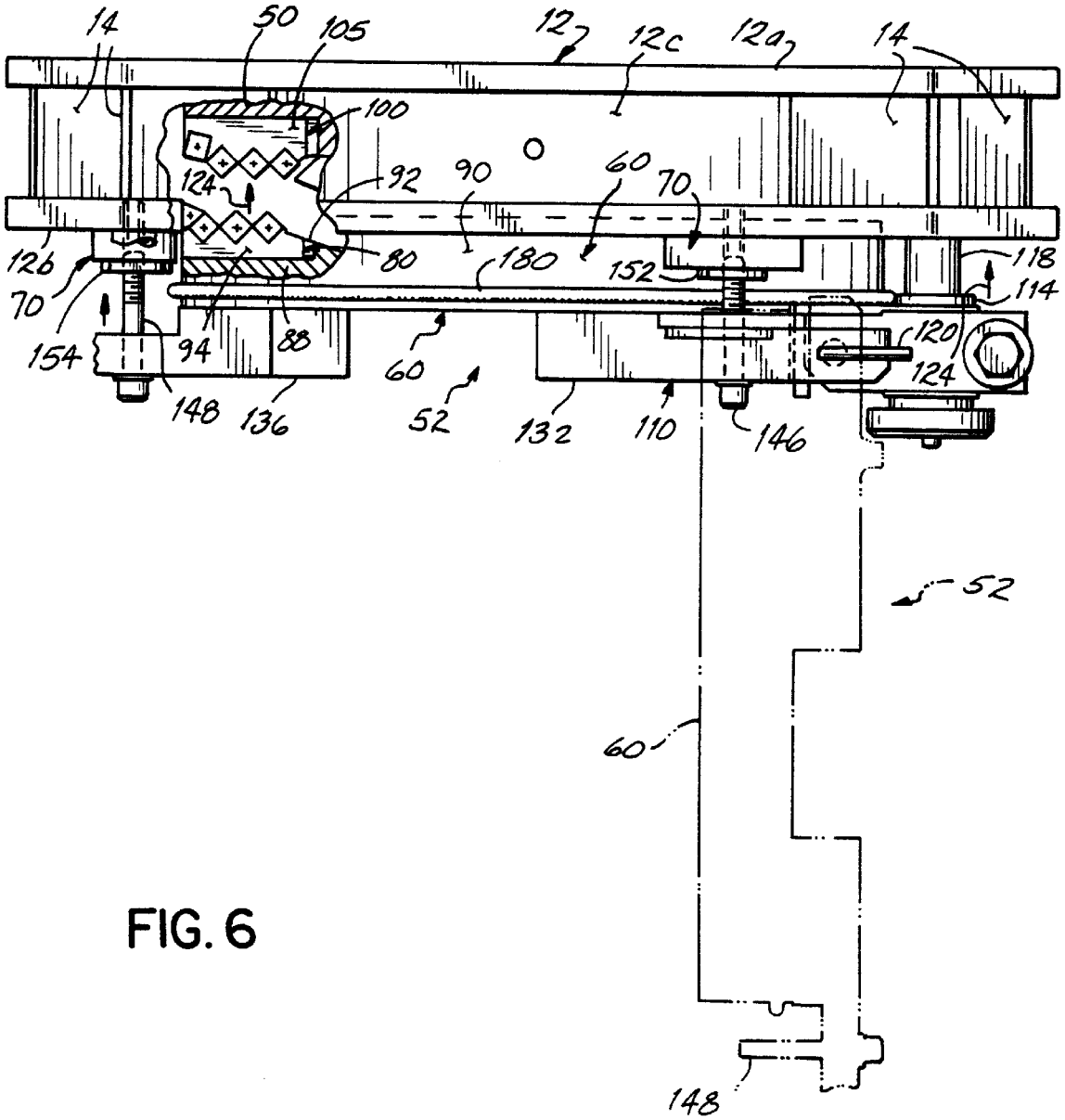
FIG. 6 is a diagrammatic top view of the grinding portion of the apparatus shown in FIG. 1 schematically illustrating the door and attached stationary disc being moved to the closed position adjacent the rotating disc or plate.
Figure 8:
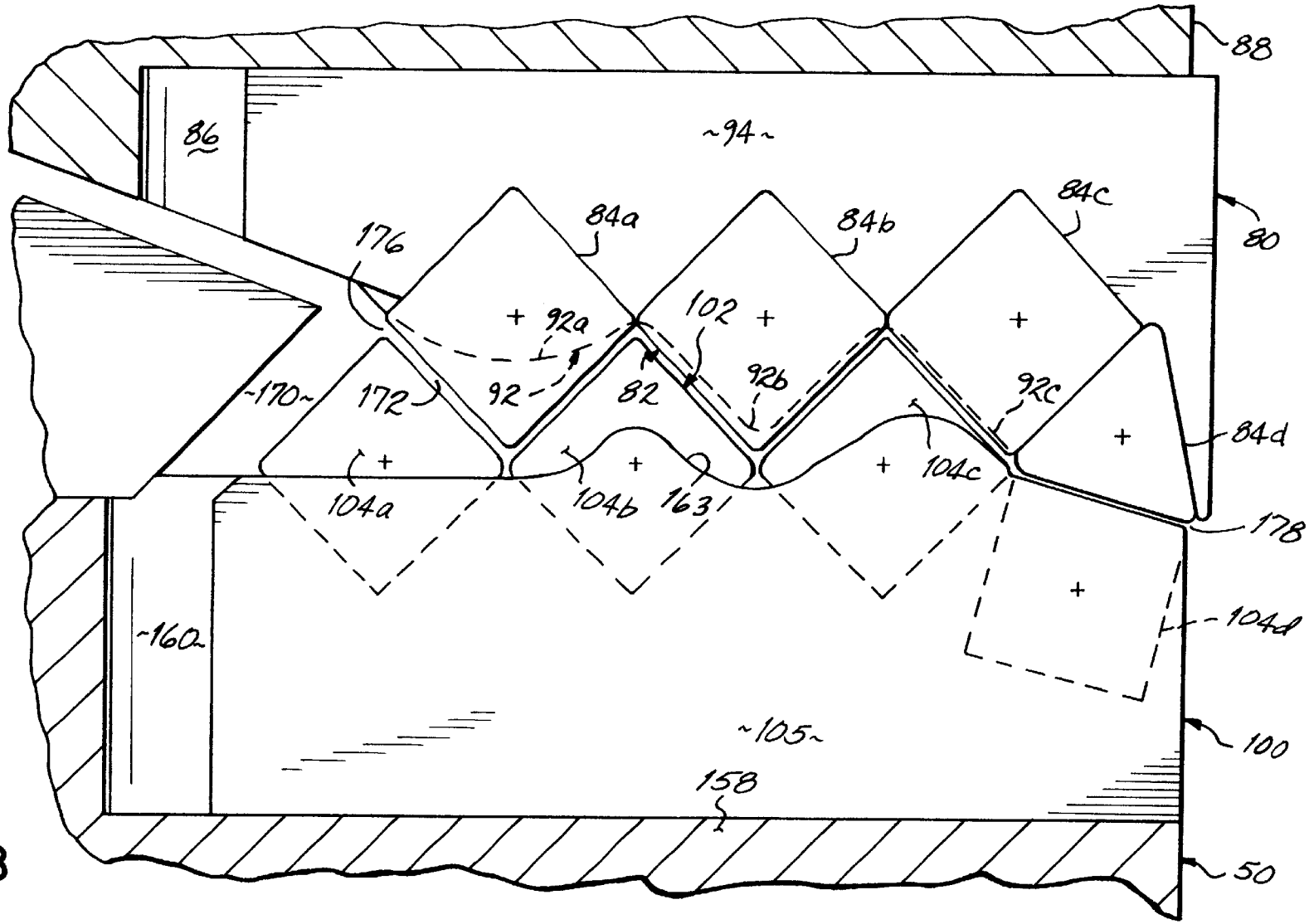
FIG. 8 is an enlarged view similar to FIG. 7, but better illustrating the engagement of the serrated cutting element edges and the adjacent inclined or ramped surfaces of each disc or plate.
Figure 9:
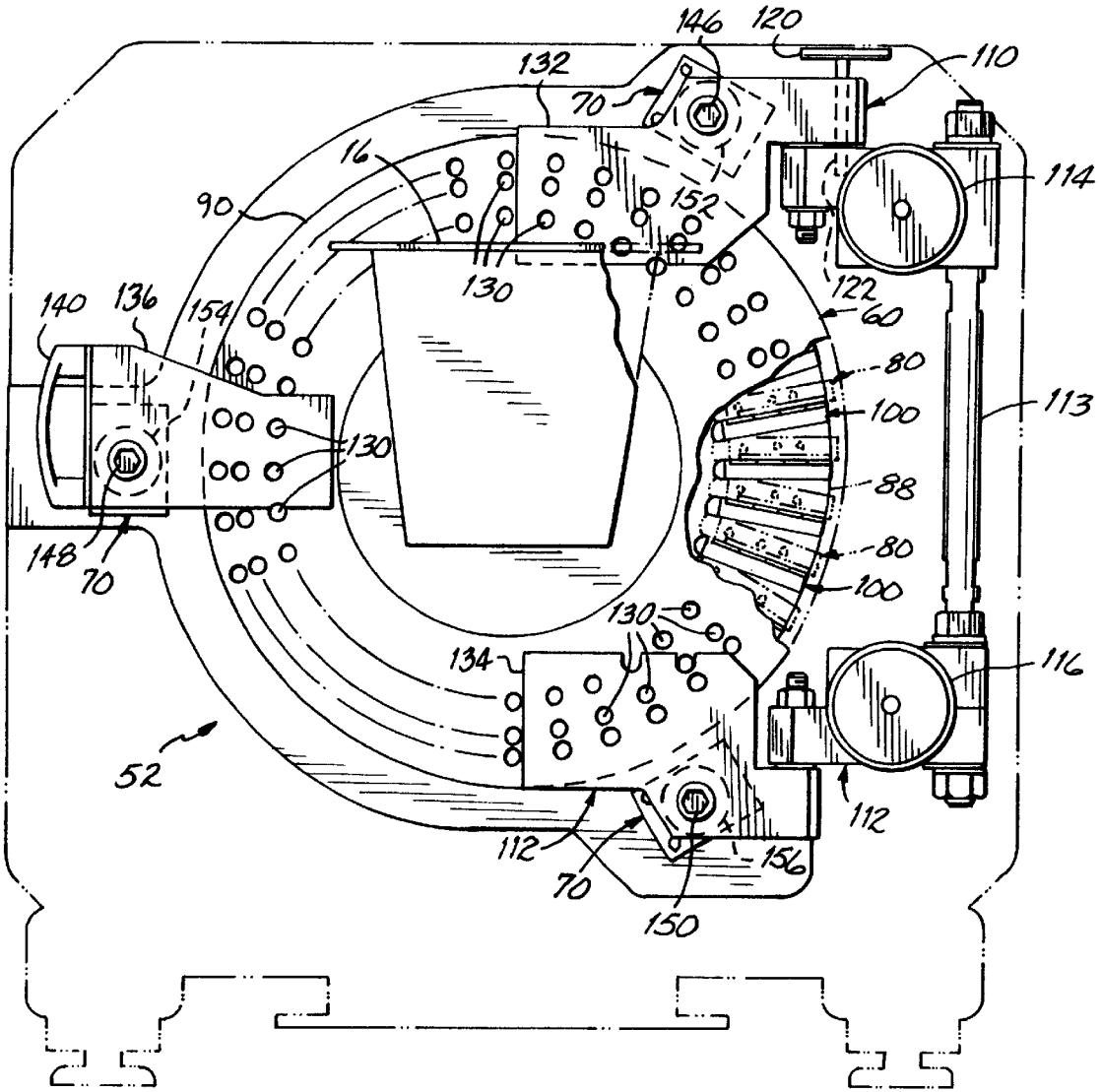
FIG. 9 is a diagrammatic front elevational view of the apparatus.

FIGS. 2, 6 and 9 illustrate the general construction and operation of the stationary disc 60, which also serves as a door to grinding chamber 40. The door 60 includes a pair of upper and lower hinges 110, 112 coupled together by a connecting rod 113 for allowing the pivoting motion shown schematically in dash-dot lines of FIG. 6 and further includes a pair of upper and lower bushings 114, 116 and linear rods 118 (FIG. 6, only one shown) for allowing linear motion of the door 60 upon movement to the initial closed position shown in FIG. 6 in solid lines. Upon movement to this position, a pin 120 is dropped into a hole 122 (FIG. 9) in the upper hinge structure 110 to prevent further pivoting motion and the door 60 then may be pushed linearly using bushings 114, 116 in the direction indicated by the arrows 124 from the spaced apart position shown in FIG. 6 to the position suitable for grinding, as will be discussed below in connection with FIGS. 7 and 8. As further shown in FIG. 9, holes 130 are provided in the door 60, as well as in the three mounting flanges 132, 134, 136 to allow access to fasteners used to fix the cutting elements 80 in place in the annular support ring 88 as will be discussed below. Two mounting flanges 132, 134 form parts of hinges 110, 112, while the third flange 136 mounts a handle 140 of door 60. Once the door 60 is in the fully closed position, three threaded rods 146, 148, 150 are tightened to secure three pads 152, 154, 156 of the door 60 against three pads (to be described below) associated with the respective adjustment mechanisms 70.

Figure 7:
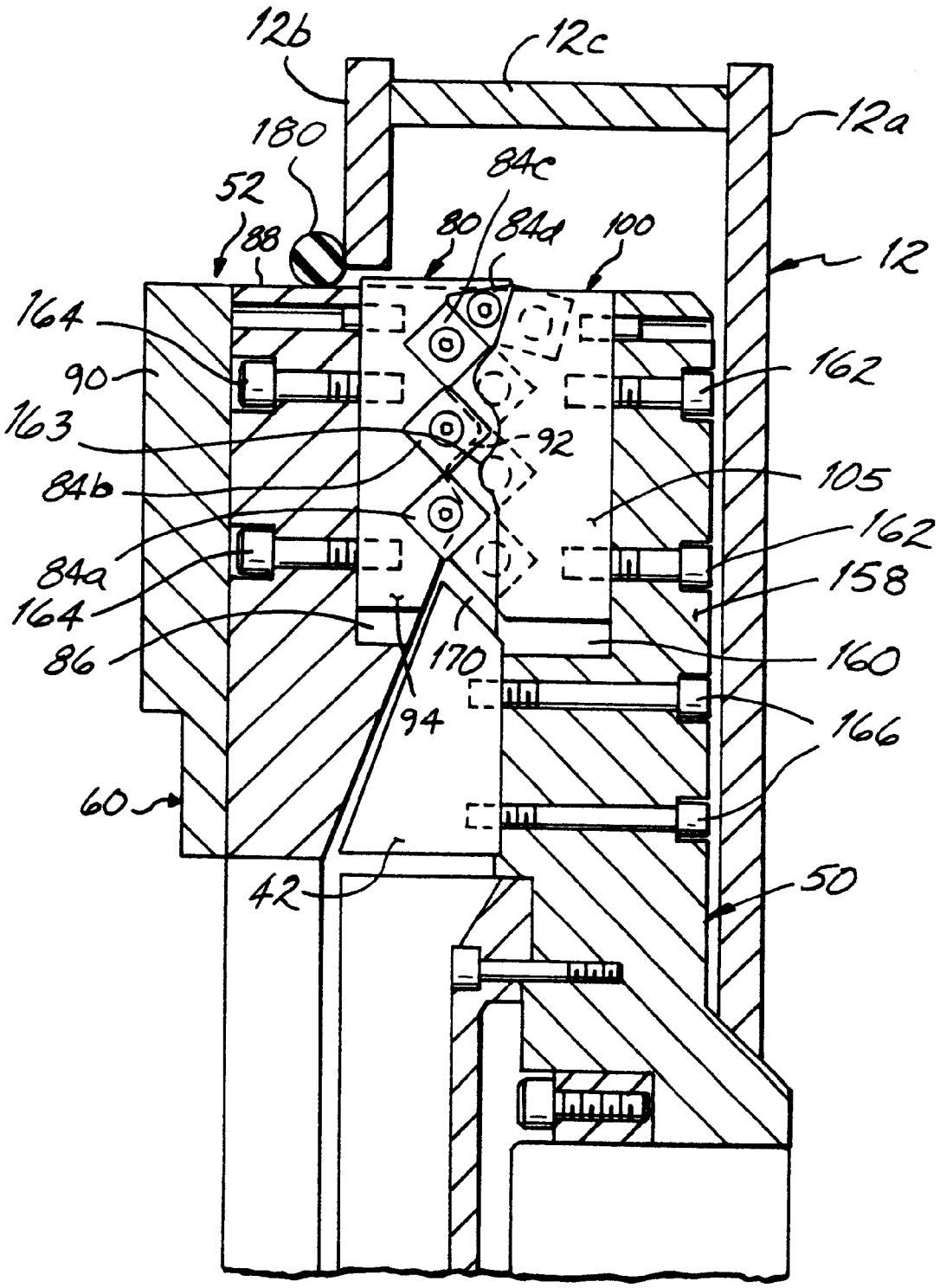
FIG. 7 is a cross sectional view taken generally radially through the stationary and rotating discs or plates in a position suitable for grinding.

As shown in FIGS. 7 and 8, an annulus support ring 158 is mounted for rotation within housing 12 and carries the plurality of generally radially extending cutting elements 100. Cutting elements 100 are received and retained in recesses 160 of support ring 158 using fasteners 162. Similar fasteners 164 are used to retain cutting elements 80 in respective recesses 86 of annular support ring 88. Fasteners 166 retain material distribution wheel 42 on annular support ring 158. The remaining connections and fastening structure, bearings, etc., necessary to rotate annular support ring 158 and cutting elements 100 with respect to annular support ring 88 and cutting elements 80 may be the same as described in the above incorporated '610 patent. Once the door 60 is closed and fixed in the grinding position, a grinding space 170 is created between two generally inclined and undulating surfaces 92, 163 of the annular support rings 88, 158 that respectively mount the generally radially extending cutting elements 80, 100. As best illustrated in FIG. 8, this grinding space 170 generally narrows in a radially outward direction to help ensure size reduction of the particulate material as it is centrifugally thrown in a radially outward direction into the space by the distribution wheel 42. In addition, a gradually narrowing shearing space 172 (FIG. 8) is formed between the respective serrated edges 82, 102 to ensure size reduction between a radially inward location 176 and a radially outermost position 178. Once the particulate material exits at the radially outermost position 178, the material falls downward in housing 12 (FIG. 1) and out from outlet 18. A seal 180 prevents any of the particulate material from exiting the housing at the juncture with the door 60.

Figure 10:
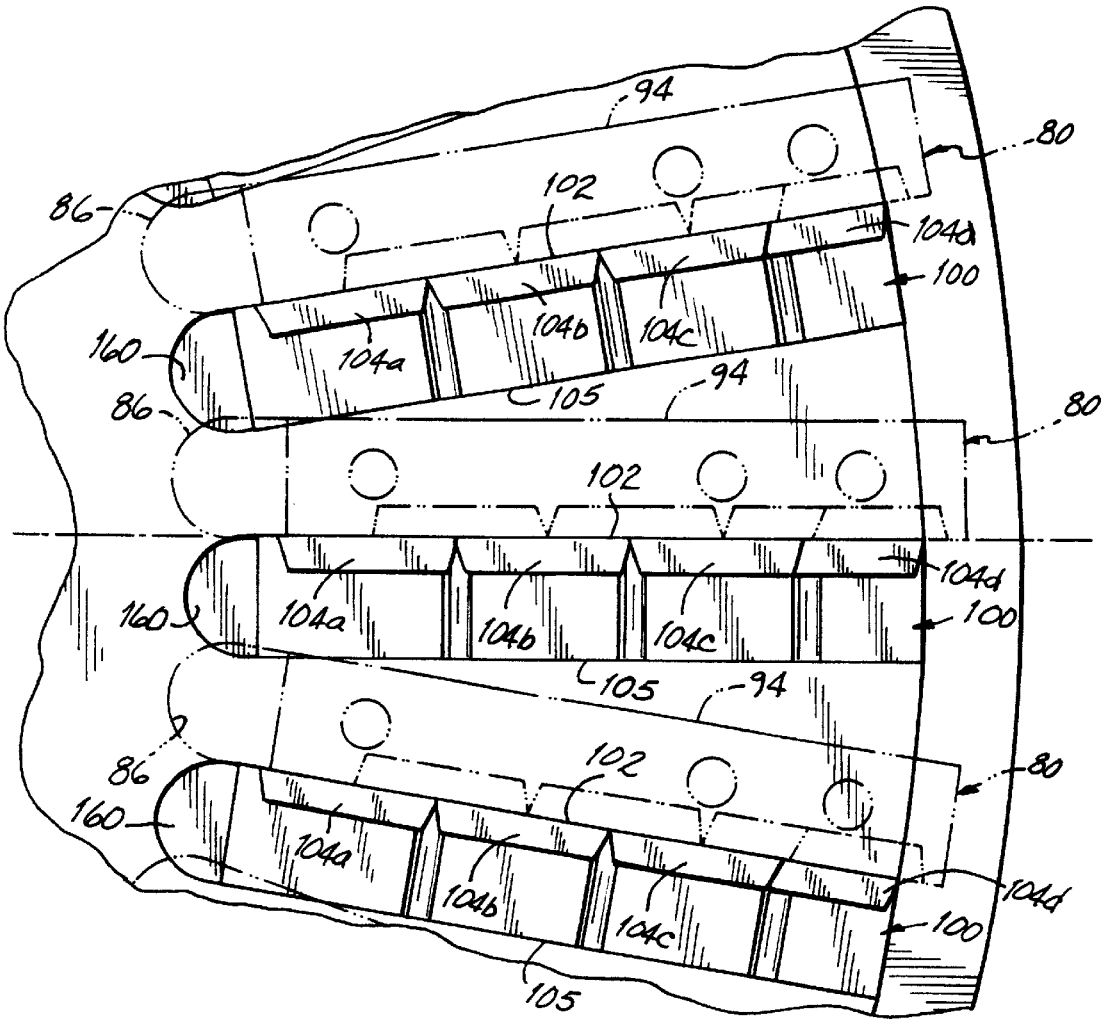
FIG. 10 is an enlarged, fragmented front elevational view similar to FIG. 9, but illustrating the parallel interaction between the cutting elements on the respective discs or plates.

FIGS. 9 and 10 further illustrate the parallel relationship between the respective elongate cutting elements 80, 100. These cutting elements 80, 100 preferably do not extend exactly along a radially directed line through the center or axis of rotation of each plate 50, 60, but rather extend parallel to one another so that upon closing the door 60 into the grinding position shown in FIGS. 7 and 8, each of the cutting elements and, more specifically, the serrated edges 82, 102 (FIG. 8) intermesh in a precise manner.

FIG. 11 illustrates a cross section of one of the adjustment mechanisms 70 with the understanding that the remaining adjustment mechanisms 70 are constructed in an identical manner. A block 200 retains an inner sleeve 202 by way of a roll pin 204. The inner sleeve 202 includes threads 206 on its outer surface which engage threads 208 in the bore 210*a* of a pad 210. The pad 210 is retained within a recess 212 of the block 200 and a spacer 214, retained by a fastener 216, is used to set the minimum outward extension of a gauge surface 210*b* the pad 210 from the block 200. The pad 210 may be rotated, when a set screw 218 is loosened, to set the distance that its outer gauge surface 210*b* extends toward the door 60, or generally away from plate 12*b* the housing 12. The spacer 214 defines the minimum distance that the door may be closed with respect to plate 12*b*. This sets the minimum gap between the respective cutting elements 80, 100 and serrated edges 82, 102 thereof to ensure that these cutting elements 80, 100 and serrated edges 82, 102 cannot come into contact with one another. Conventional measurement indicators, such as a dial indicator, may be used to set each of the pads 210 associated with the three adjustment mechanisms 70 at the proper position. Adjustment mechanisms 70 are spaced apart by 60° on the housing 12 to achieve a proper and consistent gap at all grinding surfaces between the grinding plates 50, 60. When the door or plate 60 is closed, the plurality of threaded rods 146, 148, 150 are received within the respective inner sleeves 202 and threaded into the housing plate 12*b* as shown in FIG. 6. The threaded rods 146, 148, 150 are tightened until pads 152, 154, 156 on the door are tightened against the pad gauge surfaces 210*b* associated with each corresponding adjustment mechanism 70.

In operation, material (not shown) such as waste automobile tire pieces is fed into the inlet 16 and into the grinding chamber 40. The drive 30 rotates the material distribution wheel 42 and the attached rotating disc or plate 50 with respect to the stationary disc or plate 60, for example, at a speed of approximately 325 rpm. The centrifugal force created by this rotating action forces material pieces in a radially outward direction within grinding space 170 and shearing space 172 such that these pieces, which may be on the order of ¼ inch to ⅜ inch in size are ground into smaller and smaller particulate pieces until they reach the radially outermost position 178 of each plate where upon they reach a size sufficiently small to exit the grinding chamber 40. When the distance between the respective serrated edges 82, 102 at the radially outermost position 178 is approximately 0.006 inch, particulates exiting this gap may be on the order of −20 to −40 mesh. In this example, the gap at radially inner position 176 between serrated edges 82, 102 may be approximately 0.012 inch. The output particles are directed into material outlet 18 located at the bottom of the housing either by gravity or by an air assist or vacuum pressure which may be operatively connected to the outlet 18.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features and concepts of the invention may be used alone or in numerous combinations depending on the needs and preferences of the user. This has been a description of the present invention, along with the preferred methods of practicing the present invention as currently known. However, the invention itself should only be defined by the appended claims, wherein

We claim:

1. Centrifugal grinding apparatus comprising:

a housing including an inlet and an outlet;

a first plate secured within said housing and including a first inclined surface and a first plurality of generally radially extending cutting elements, each of said first plurality of generally radially extending cutting elements defining a first serrated edge extending above said first inclined surface; and a second plate mounted within said housing and including a second inclined surface and a second plurality of generally radially extending cutting elements, each of said second plurality of generally radially extending cutting elements defining a second serrated edge extending above said second inclined surface and intermeshing with said first serrated edge, said first and second inclined surfaces opposing one another and defining a grinding space therebetween that gradually becomes more narrow in a radially outward direction;

wherein one of said first and second plates is mounted for rotation within said housing and a drive is operatively coupled to said one plate for rotating said one plate during a grinding operation.

2. The apparatus of claim 1, wherein each of said radially extending cutting elements of said first and second pluralities of generally radially extending cutting elements further comprises a plurality of multi-sided blade elements retained on an elongate support member, at least one side of each multi-sided blade element having a cutting edge defining a portion of the corresponding serrated edge.

3. The apparatus of claim 2, wherein two sides of at least some of said multi-sided blade elements define said portion of the corresponding serrated edge.

4. The apparatus of claim 2, wherein said multi-sided blade elements each have at least three sides with each side defining a cutting edge and each blade element is retained on said elongate support member in a manner allowing rotation to select a different one of said cutting edges to partially define a corresponding one of said serrated edges.

5. The apparatus of claim 4, wherein at least some of said multi-sided blade elements have four sides with each side defining one of said cutting edges.

6. The apparatus of claim 1, wherein said first and second inclined surfaces further comprise undulating surfaces generally following the respective serrated edges.

7. The apparatus of claim 1, wherein a shearing space is defined between said first and second serrated edges, said shearing space becoming gradually more narrow in a radially outward direction.

8. The apparatus of claim 7 further comprising at least three adjustment pads mounted adjacent said first and second plates for engaging one another during the grinding operation and thereby defining the size of said shearing space between said first and second serrated edges.

9. The apparatus of claim 8, wherein the three adjustment pads mounted adjacent one of said first and second plates are movable toward and away from the three adjustment pads mounted adjacent the other one of said first and second plates.

10. The apparatus of claim 1, wherein said first and second plates each include a plurality of generally radially extending recesses in the respective first and second inclined surfaces and the respective cutting elements of said first and second plurality of generally radially extending cutting elements are removably retained in said recesses.

* * * * *